US010166588B2

(12) United States Patent
Kim et al.

(10) Patent No.: US 10,166,588 B2
(45) Date of Patent: Jan. 1, 2019

(54) APPARATUS FOR FORMING A STEEL WORKPIECE

(71) Applicant: MS AUTOTECH CO., LTD., Gyeongju-si, Gyeonesanebuk-do (KR)

(72) Inventors: Jang Soo Kim, Gwacheon-si (KR); Dae Ho Yang, Suwon-si (KR); Hyun Woo Lee, Suwon-si (KR); Hong Kyo Jin, Suwon-si (KR); Woo Young Kim, Suwon-si (KR)

(73) Assignee: MS AUTOTECH CO., LTD., Gyeongju-si (KR)

( * ) Notice: Subject to any disclaimer, the term of this patent is extended or adjusted under 35 U.S.C. 154(b) by 408 days.

(21) Appl. No.: 14/965,942

(22) Filed: Dec. 11, 2015

(65) Prior Publication Data

US 2017/0021404 A1 Jan. 26, 2017

(30) Foreign Application Priority Data

Jul. 24, 2015 (KR) ..... 10-2015-0105345

(51) Int. Cl.

| | |
|---|---|
| ***B21D 22/02*** | (2006.01) |
| ***B21D 31/00*** | (2006.01) |
| *B30B 15/34* | (2006.01) |
| *B21J 9/08* | (2006.01) |

(52) U.S. Cl.

CPC ..... *B21D 22/02* (2013.01); *B21D 22/022* (2013.01); *B21D 31/00* (2013.01); *B21J 9/08* (2013.01); *B30B 15/34* (2013.01)

(58) Field of Classification Search

CPC . B30B 15/34; B21J 9/08; B21D 31/00; B21D 22/02; B21D 22/022

See application file for complete search history.

(56) References Cited

U.S. PATENT DOCUMENTS

| | | | | |
|---|---|---|---|---|
| 4,989,153 A * | 1/1991 | Bonvini | B30B 15/34 | 219/149 |
| 6,192,733 B1 * | 2/2001 | Long | B30B 1/42 | 100/256 |
| 6,612,826 B1 * | 9/2003 | Bauer | B30B 11/005 | 425/135 |
| 7,732,734 B2 * | 6/2010 | Machrowicz | B21D 9/076 | 219/161 |

FOREIGN PATENT DOCUMENTS

KR 10-1368276 B1 2/2014

* cited by examiner

*Primary Examiner* — Pradeep C Battula
(74) *Attorney, Agent, or Firm* — Sughrue Mion, PLLC

(57) ABSTRACT

Provided is an apparatus for forming steel workpieces using electroplasticity. The apparatus includes a power supply (40) for supplying electricity to the workpiece (W) through electrodes (30) disposed in a mold (20) of a press (10) during a deformation stroke of the press (10), a control unit (50) for controlling the power supply (40) and a plurality of sensors (60, 70, 80 and 90).

14 Claims, 8 Drawing Sheets

APPARATUS FOR FORMING A STEEL WORKPIECE

CROSS-REFERENCE TO RELATED APPLICATIONS

This U.S. non-provisional patent application claims priority under 35 U.S.C. § 119 of Korean Patent Application No. 10-2015-0105345, filed on Jul. 24, 2015, the entire contents of which are hereby incorporated by reference.

BACKGROUND

The present disclosure herein relates to a process and apparatus for forming steel workpieces, especially high strength steel workpieces, using an electrical current passing therethrough.

There are high requirements in terms of vehicle components with lightweight properties and high strength due to fuel efficiency regulations and strengthening of safety laws. Ultra high strength steel workpieces having strength over 1 GPa have been commercialized, and recently, development of steel having strength over 2 GPa is proceeding.

In general, if a steel plate increases in strength, then the steel plate decreases in elongation and is deteriorated in machinability or formability. To solve this limitation, a new technology that is so-called hot stamping process was suggested. In the hot stamping process, a steel plate is heated at a temperature of about 900° C. and press-formed, and thus formability is very excellent.

However, the workpieces strengthened by the hot stamping causes another problem, trimming. To trim high strength steel using a press, the trimming tool may be frequently broken, and thus trimming using the press cannot be applied to mass production of the high strength steel components. At present, a laser is used to trim the hot-stamped high strength steel workpiece.

SUMMARY

The above-described laser cutting has a long cycle time and requires post-machining to eliminate burr. Thus, a new technology capable of cold-trimming high strength steel is needed.

Electroplasticity is a phenomenon in which, when an electrical current is applied to a metal, the metal is temporarily reduced in strength and varies in elongation. Recently, electroplasticity receives attention, however, the principle of the electroplasticity has not been clearly identified, and systemic studies to the extent to commercialize electroplasticity in industry have not been conducted yet.

The inventors of the present invention have been studied on a method of forming an ultra high strength steel using the electroplasticity and, as one of the results, achieved Korean Patent Registration No. 1368276. The invention disclosed in this patent was that of an early development stage and has limitations to apply in the industry.

According to Korean Patent Registration No. 1368276, an electrical current is supplied to a steel workpiece before a trim cutter of an upper die contacts the steel workpiece. However, it was difficult to obtain desired strength reduction by the invention. It was necessary to improve the process and apparatus so as to commercialize the electroplastic forming using presses.

The present invention is obtained from the results of research and development to apply and commercialize an electrically-assisted forming process for the hot-stamped ultra high strength steel workpieces.

The present invention provides an advanced electrically-assisted forming apparatus, which is capable of forming ultra high strength steel workpieces.

An embodiment of the inventive concept provides an apparatus for forming a high strength steel workpieces, the apparatus including: a press including an upper mold and a lower mold; a power supply for supplying current to an electrode disposed in the lower mold; a control unit for controlling the power supply; and a first sensor disposed on the upper mold or the lower mold to measure a force applied to the workpiece and transmit the measured value to the control unit.

In an embodiment, the press may temporarily stop the motion of the upper mold at a predetermined position. Also, the control unit may control a start timing of the power supply to supply an electrical current to the electrodes by using an input value from the first sensor and determines as the start timing a certain time after the workpiece is pressed by a forming tool of the upper mold.

Also, in an embodiment, the power supply may be provided more than two so that electrical currents for electroplastic effect are independently supplied to different areas of the workpiece. It is useful to stably supply the electrical current to the workpiece, and also useful when a certain portion of the workpiece has a thickness or material different from other portions of the workpiece, or when a portion of the workpiece should be treated different from other portions of the workpiece.

Also, in an embodiment, the forming apparatus is configured to temporarily stop the descending movement of the upper mold on or before the start timing, and restart the movement before the current supply ends. The current may be applied to the workpiece until the upper mold reaches a bottom dead point.

The status of the electrically-assisted forming process may be monitored by the control unit. For this, the control unit receives and records data from the press, the power supply and sensors. The control unit is different from a controller for controlling the motion of the press.

Also, in an embodiment, the forming apparatus may further include a second sensor for measuring current supplied from the power supply to the electrode to transmit the measured value to the control unit. Since the control unit uses the first and second sensors, the control unit may accurately control or monitor the electroplastic forming process, and thus products with high quality may be obtained.

DETAILED DESCRIPTION

Figure 1:
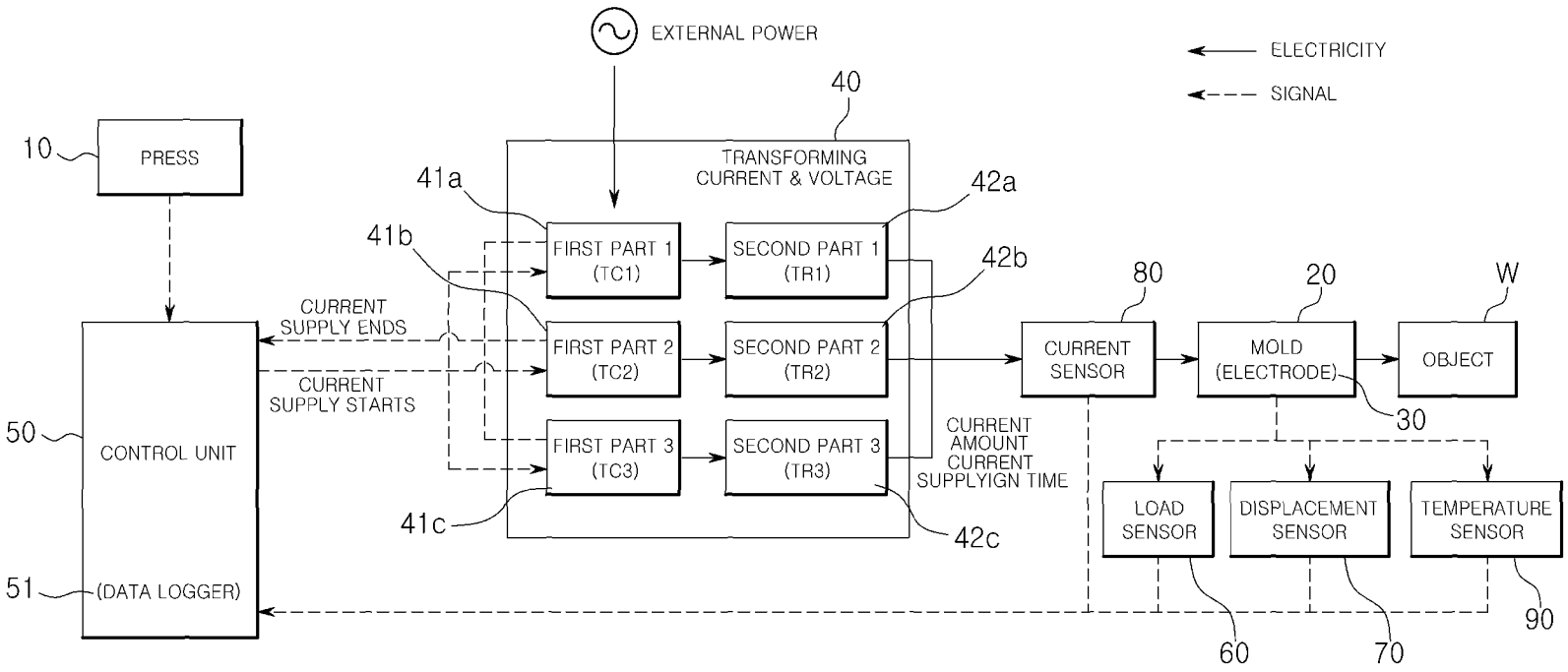
FIG. 1 is a schematic view of an apparatus for forming high strength steel workpieces according to an embodiment of the present invention.

Hereinafter, exemplary embodiments of the inventive concept will be described in detail with reference to the accompanying drawings. Like reference numerals or symbols refer to like elements throughout.

Figure 2:
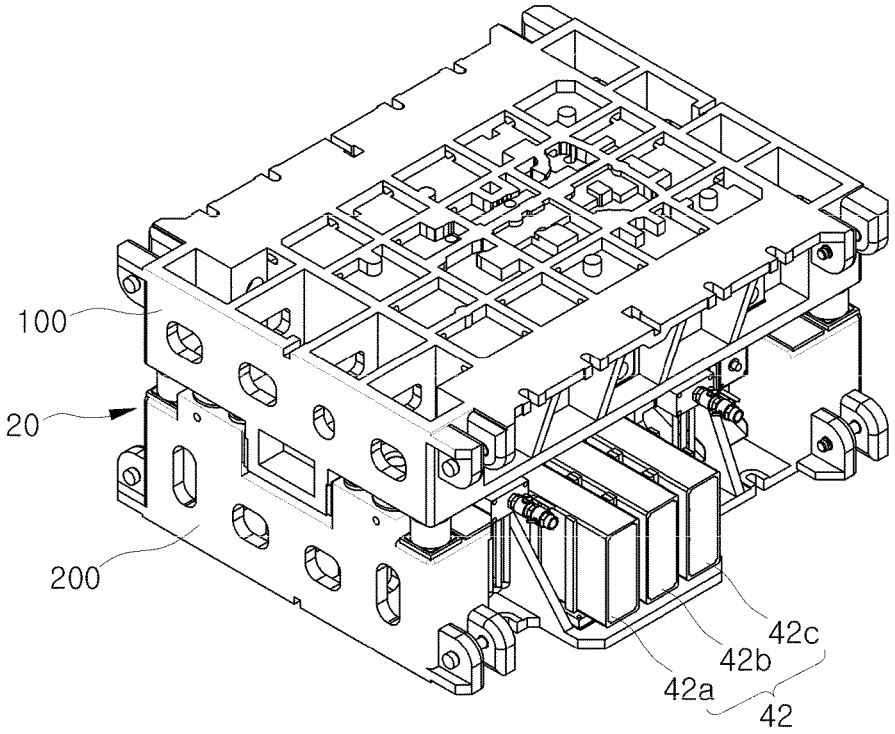
FIG. 2 is a view of a mold according to the embodiment of the present invention.

FIG. 1 is a block diagram illustrating an apparatus for forming high strength steel workpieces (hereinafter, referred to as a "forming apparatus") according to an embodiment of the present invention. FIG. 2 is a view of a mold according to the embodiment of the present invention.

Referring to FIGS. 1 and 2, a forming apparatus has a structure in which an electrical current is supplied from a power supply 40 to an workpiece W through electrodes 30 disposed in a mold 20 of a press 10 during a forming process of the workpiece W. The forming apparatus includes a control unit 50 for controlling the power supply 40 and also have sensors 60, 70, 80, and 90.

The press 10 needs to be configured to temporarily stop the motion of slide so that an upper mold 100 can be stopped during its deformation stroke. According to an embodiment, a servomotor may be applied to the press 10 to stop movement of the upper mold 100 at a desired position. When the press 10 re-operates, there is no change in torque of the press 10.

The mold 20 is mounted on the press 10. The mold 20 includes the upper mold 100 which corresponds to the slider and a lower mold 200 which corresponds to a bolster. The electrodes 30 for applying the current to the workpiece for an electrical assisted forming are disposed on the lower mold 200.

At least a pair of electrodes 30, an anode and a cathode, are provided in the forming apparatus. The electrodes 30 may be disposed in the lower mold 200 and/or upper mold 100. Preferably the electrodes 30 are disposed in the lower mold 200 according to the embodiment of the present invention. In a case of a trimming apparatus, since the electrode has to be disposed at most of the trimming positions, a plurality of electrodes 30 are needed.

The power supply 40 converts AC current supplied from an external power source into DC current to use it for an electrically assisted forming. The power supply 40 generates a pulsed direct current and supplies it to a portion of the steel workpiece W through the electrodes 30. For example, the external power is 3-phase current of about 380 to 440 V. The 3-phase current is converted to a lower voltage of about 8 V and a higher current of about 40,000 A for the electrically assisted forming.

To perform electroplastic forming, it is necessary to accurately control at least a start timing at which current starts to be supplied from the power supply 40 to the electrodes 30. The sensors 60, 70, 80, and 90 are disposed on the mold 20. A measurement value of each of the sensors is collected to a data logger 51 of the control unit 50. The control unit 50 may determine a current supply start-up time by using a measurement value received from a load sensor 60 to transmit the current supply start-up time to the power supply 40.

In addition to the current supply start-up time, it is necessary to control a current supplied time or a current supply ending time, a current amount, an interval between the current supply start-up times. Although these controls are directly performed by the control unit 50, it may be convenient that when the control unit 50 commands to start the supply of the current, the power supply 40 supplies current to the electrodes 30 according to predetermined values such as the current amount, the current supplied time, and so on.

A current sensor 80 for measuring a current amount supplied from the power supply 40 and a current supplied time to transmit the measurement values to the control unit 50 is disposed between the power supply 40 and the electrodes 30. Thus, the control unit 50 may inspect whether the electroplastic forming is smoothly performed according to the predetermined values by using the measurement values of the current sensor 80.

If a current supply ending signal is transmitted from the power supply 40 to the control unit 50 when the current is completely supplied, the control unit 50 may prepare a next electroplastic forming with respect to another workpiece.

The measurement value received from the current sensor 80 may be used to determine or inspect whether the current is completely supplied or to determine or inspect the current supply ending time.

The power supply 40 or the control unit 50 described in embodiments of the present invention are for the electroplastic forming. A control part and a power part which are needed to operate the press 10 such as elevation of the upper mold 100 may be separately provided.

Basic sensors such as a displacement sensor may be disposed on the press 10. However, for example, the displacement sensor of the press 10 reads a displacement amount with a cam angle. This value is inconvenient to use and inadequate to accurately read the motion of a forming part 121, of the upper mold 100. It is preferably to use other accurate displacement sensor 70 separately to the movement of the forming part 121 of the upper mold 100. The displacement sensor 70 transmits measured values to the control unit 50.

Values measured by the sensors disposed on the press 10 may be collected to the control unit 50. Information regarding an operation standby state of the press 10 or regarding whether the workpiece W is loaded may be obtained from the measured values and may be used to prepare the electroplastic forming or to determine whether the press 10 is abnormal.

According to the embodiment, the power supply 40 may include a first part (TC) and a second part (TR).

Referring to FIGS. 1 and 2, the first part 41 is a module for converting external AC power into DC power and for controlling a current amount flowing to the electrodes 30, a current supplied time, and a current supply repeated period. A current supply starting command from the control unit 50 is inputted to the first part 41. The first part 41 starts to supply current according to the command and supplies current to the electrodes 30 according to a predetermined current amount and current supplied time.

As illustrated in FIG. 2, the second part 42 is a module for changing the current and voltage supplied from the first part 41 into values required to electroplastic forming to supply the values to the workpiece W. For example, the second part 42 converts the current received from the first part 41 into a low voltage of about 8 V to about 16 V and high current of about 1,000 A to about 40,000 A to supply the converted low voltage and high current to the electrodes 30.

The second part 42 is directly mounted on the lower mold 20. This is done because as a distance between the second part 42 and the electrodes 30 increases, a loss due to a resistance may increase. The second part 42 is connected to the electrodes 30 by a bus-bar protected with an insulated tube.

At least two power supplies 40 may be provided in the forming apparatus. Referring to FIG. 1, the apparatus may have three power supplies 41*a*, 42*a*, 41*b*, 42*b*, 42*c*, and 42*c* disposed in the lower mold 200. Each power supply supplies an electrical current to a portion or section of the workpiece W independently from other power supplies.

Each of the electrodes may belong to one group of at least two groups and each of the power supplies is electrically connected to one of the electrode groups to supply the electrical current independently with respect to other electrode groups.

Using several power supplies 40 as described above is useful when a certain portion of the workpiece W has a thickness or material component different from other portions of the workpiece W, or when a certain portion of the workpiece W needs to be treated with a current amount and/or current supplying time different from other portions of the workpiece W. Also, since the work-load for supplying the electrical current to the electrodes 30 is divided by the power supplies 40, the current may be stably supplied even though the work-load is relatively high.

Referring to FIG. 1, the sensors 60, 70, 80, and 90 are separately disposed on a device to perform the electroplastic forming unlike a sensor basically disposed on the press 10. Each of the sensors 60, 70, 80, and 90 is disposed on the mold 20 or around the mold 20 to measure a value at a right position.

The load sensor 60 has to be disposed on the mold 20. Additionally, the displacement sensor 70 may be disposed on the mold 20. Preferably, the forming apparatus includes both the load sensor 60 and the displacement sensor 70. The load sensor 6 is essential in the forming apparatus according the present invention.

A temperature sensor 90 for measuring a temperature of the workpiece W may be disposed in the forming apparatus. The temperature sensor 90 transmits a measurement value to the control unit 50. When a temperature of a portion at which the current is supplied of the workpiece W increases over a certain value, the control unit 50 may transmit a current supply ending signal to the power supply 40. When the temperature of the current supplied portion of the workpiece W increases over about 300° C., the workpiece W may discolor.

The apparatus for forming ultra high strength steel workpieces according to an embodiment will be described with reference to FIGS. 1, 2 to 8. The forming apparatus is a trimming apparatus and a hot-stamped workpiece is used.

Referring to FIG. 2, the mold 20 includes the upper mold 100 and the lower mold 200. The second part 42 of the power supply 40 for supplying an electrical current to the electrodes 30 is disposed on a side portion of the lower mold 200.

Figure 3:
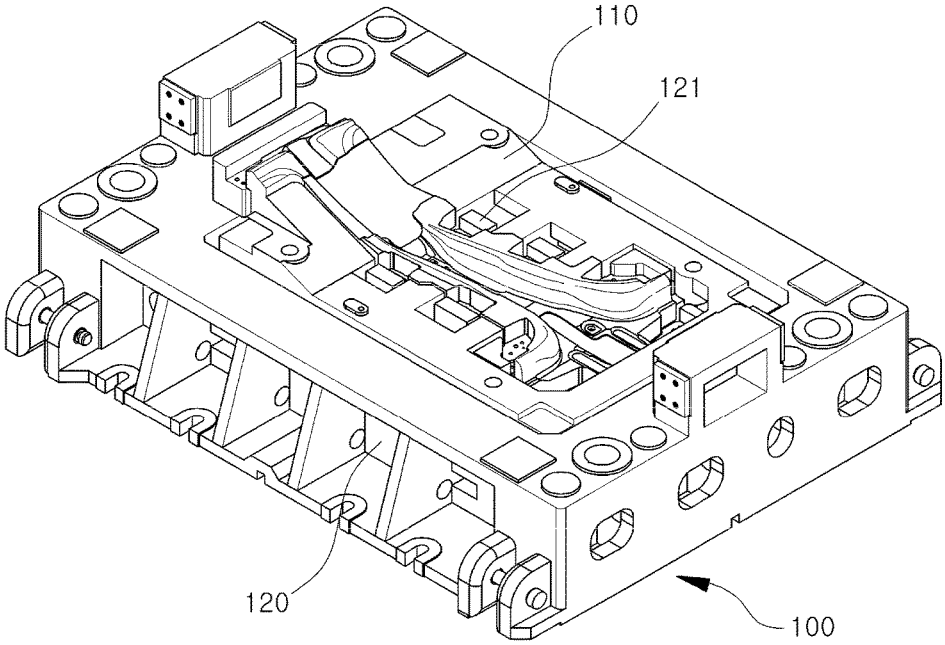
FIG. 3 is a view of an upper mold according to the embodiment of the present invention.
Figure 4:
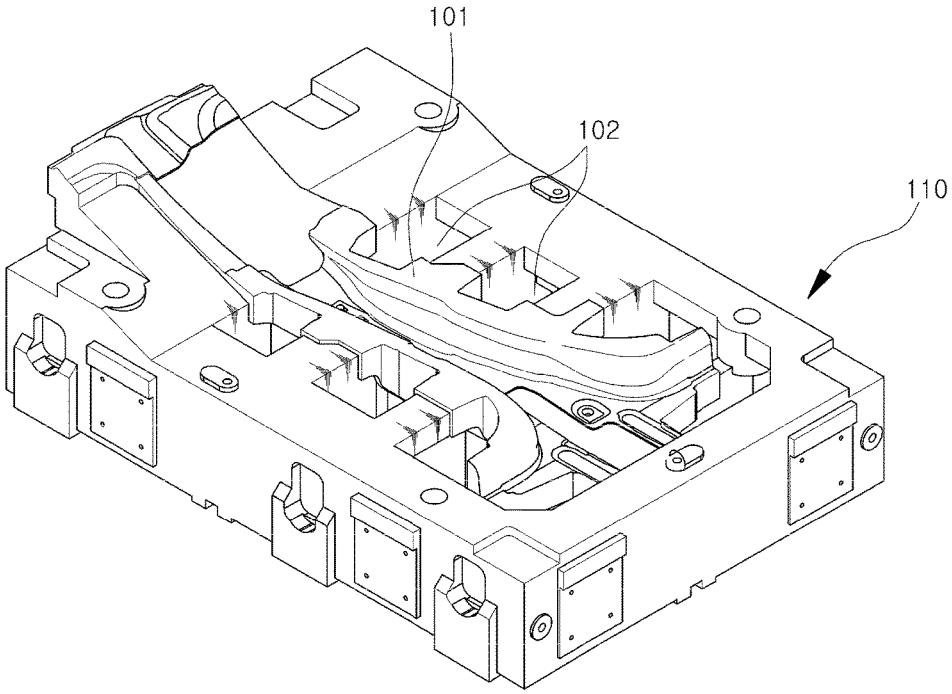
FIG. 4 is a view illustrating a pad of the upper mold of FIG. 3.
Figure 5:
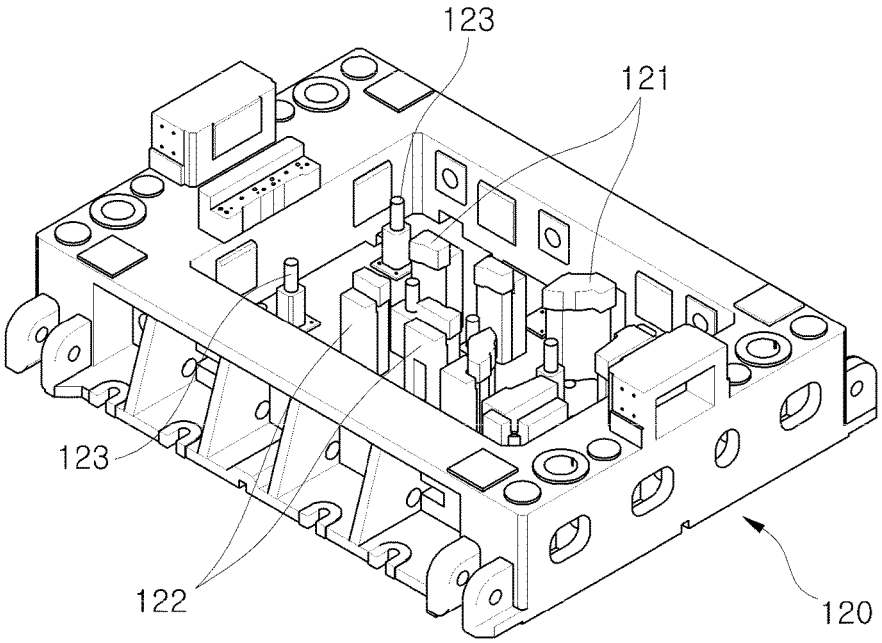
FIG. 5 is a view illustrating a die of the upper mold of FIG. 4.

Referring to FIGS. 3 to 5, the upper mold 100 is constituted by an upper die 120 having the forming part 121 and a pad 110 elastically supported by the upper die 120 so that the pad holds the workpiece W before the forming part 121 contacts the workpiece W. The forming part 121 corresponds to a trim cutter in a trimming apparatus.

The pad 110 includes a surface 101 contacting the workpiece W and through-holes 102 for allowing the forming part 121 to be exposed. Column 122 on which the forming parts 121 are disposed on fronts end thereof and members 123 for elastically supporting the pad 110 are disposed on the upper die 120. The forming part 121 are disposed at positions corresponding to the through-holes 102.

Figure 6:
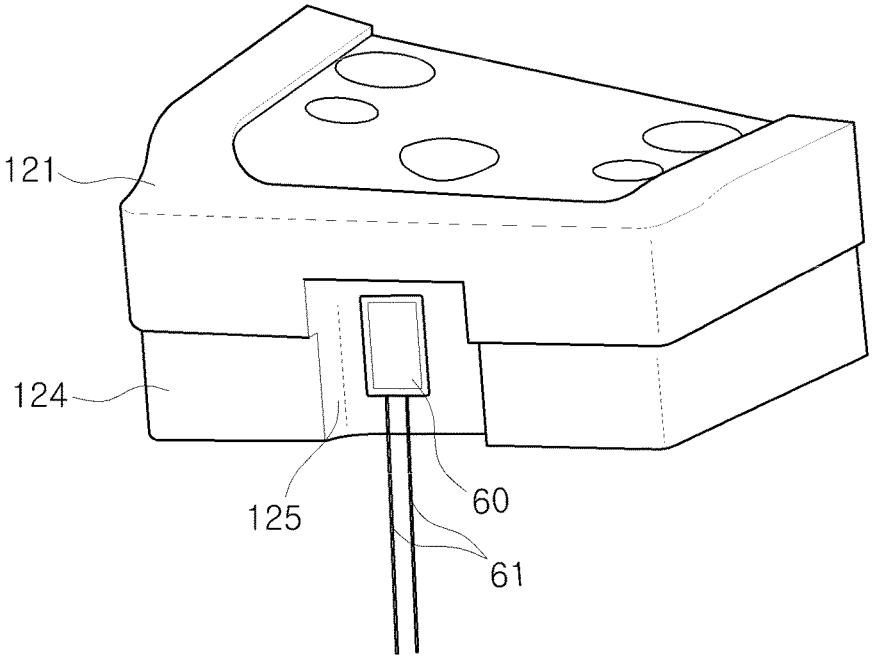
FIG. 6 is a view illustrating a state in which a load sensor is mounted according to the embodiment of the present invention.

Referring to FIG. 6, the load sensor 60 is attached to a surface 124 parallelly disposed under the forming part 121, that is, attached on a side surface of the forming part 121 in a load direction so that the load sensor 60 more accurately measures a force applied to the workpiece W by the forming part 121 or a force in which the workpiece W resists an external force.

According to the embodiment, the load sensor 60 may be a strain gage. When the forming part 121 presses the workpiece W, a force resisting the pressure force may be transmitted to the forming part 121 to slightly deform the strain gage. Deformation of the strain gage may be transmitted to the control unit 50 through a signal line 61 and calculated to a load by the control unit 50.

At least a mounting groove 125 may have an insulated surface so that noises due to the current supplied to the electrodes 30 for electroplasticity do not introduced.

Figure 7:
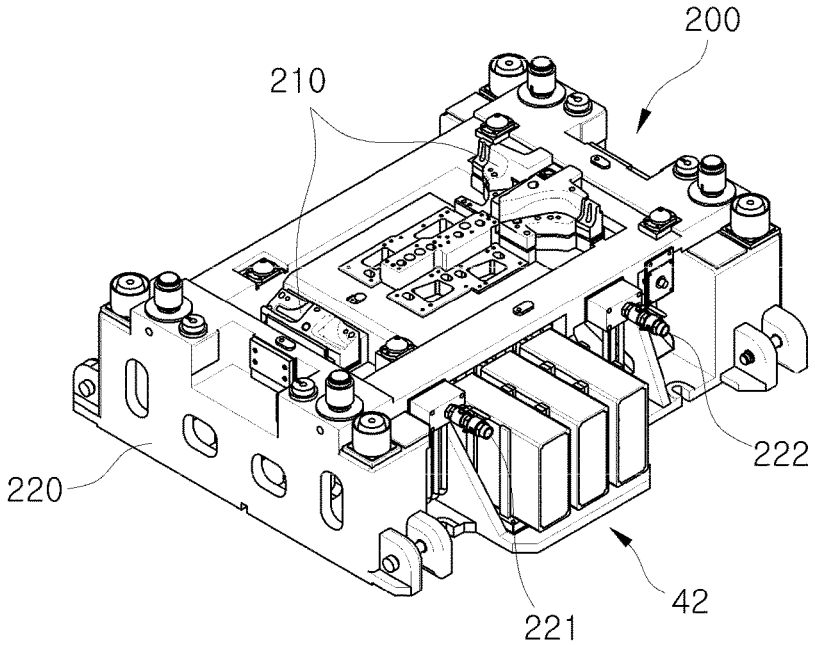
FIG. 7 is a view of a lower mold according to the embodiment of the present invention.

Referring to FIG. 7, the lower mold 200 is constituted with a lower die 220 and a steel assembly contacting the workpiece W. The second part 42 for supplying the current to the electrodes 30 is mounted on the lower die 220. A coolant line for cooling the lower mold 200 is disposed in the lower die 220. Here, the coolant line is divided to cool the second part 42.

Figure 8:
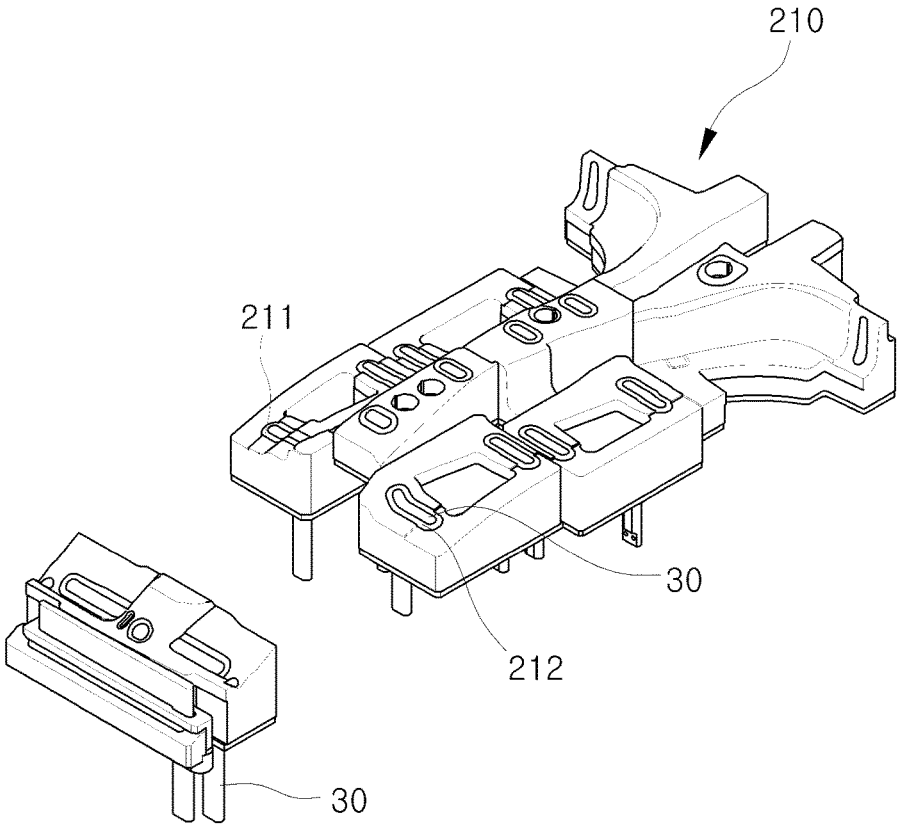
FIG. 8 is a view illustrating a steel assembly of the lower mold of FIG. 7.

Referring to FIG. 8, the electrodes 30 are disposed in the steel assembly 210. The electrodes 30 Re disposed in seating grooves 211 defined in the steel assembly 210. An insulation material 212 having elasticity is disposed between the electrodes 30 and the steel assembly 210.

According to the embodiment, the electrodes 30 are disposed in the seating grooves 211 so that the electrodes 30 protrude when compared to a surface of the steel assembly 210 to which the workpiece W contacts. Each of the electrodes is disposed higher than the surface of the steel assembly 210 to which the workpiece W contacts by about 1 mm to about 2 mm. A side surface of the electrode 30 which contacts the steel assembly 210 is protected by the insulation material 212.

When the pad 110 or the forming part 121 of the upper mold 100 presses the workpiece W, the insulation material 212 is compressed to allow the electrodes 30 to smoothly contact the workpiece W.

Hereinafter, a method of forming an ultra high strength steel workpieces using electroplasticity according to an embodiment of the present invention with reference to FIGS. 9 and 10.

Figure 9:
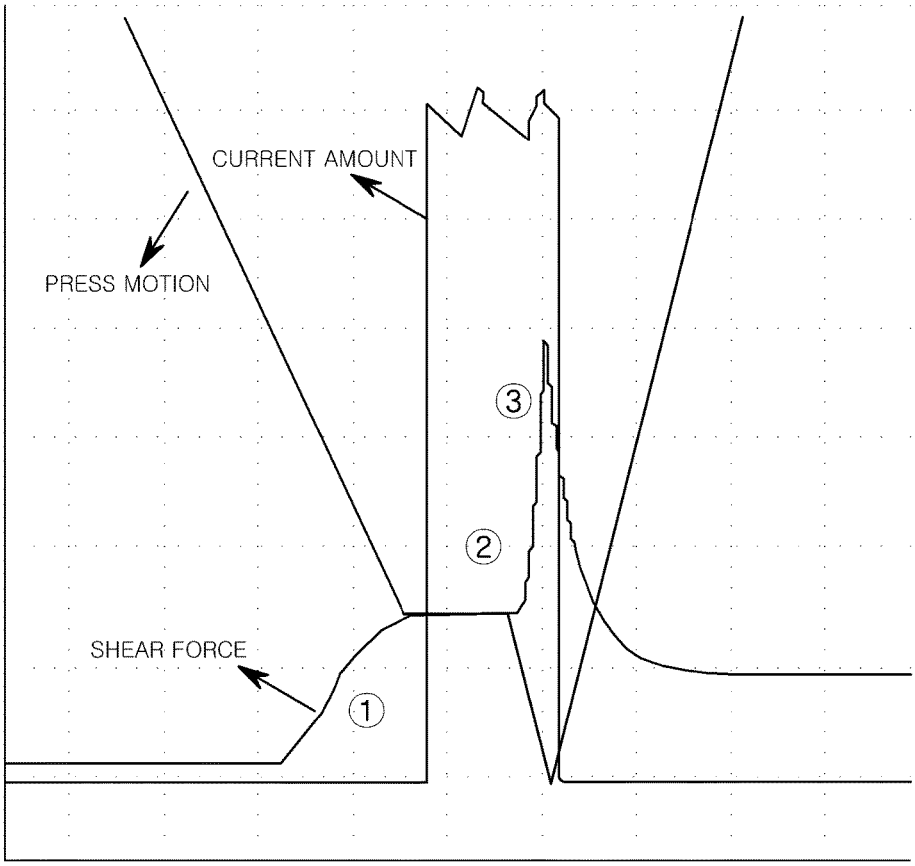
FIG. 9 is a view illustrating a condition of electroplastic forming according to the embodiment of the present invention.

In FIG. 9, the optimal trimming condition is illustrated. Also, in FIG. 10, a trimming process for realizing the optimal trimming condition is illustrated in order. Although it is an example of the trimming process, a basic process may be applied to other forming methods. The reference numerals and symbols of the components of the above-described forming apparatus will be reused.

Referring to FIG. 9, to use an electroplastic effect for forming high strength steel workpieces forming, the start timing for the electrical current supply to the workpiece W has to be selected at a time after the workpiece W is pressed and stressed by the trim cutter 121 secured in the upper mold 100. If the current supply starts after the workpiece W is pressed, and stress is accumulated, an effect of strength reduction can be sufficiently obtained.

The current supply may start at a timing that the motion of the press 10, that is, the movement of the trim cutter 121 is stopped, or may start after the movement of the trim cutter 121 is stopped. Thus, the current may be stably supplied to the electrodes, and occurrence of a spark due to the supplied current during the process may be prevented.

The current supply may be maintained for at least about 400 ms, with respect to a high strength steel plate, for example in the case of trimming hot-stamped workpiece, having a thickness of about 0.7 to 1.5 mm that is in a thickness range of a steel plate for vehicle. When the current supply is less than about 400 ms, it is difficult to obtain a suitable strength reduction. Also, when the current supply is too long, the steel plate may change in color due to Joule heating. In the case of trimming, about 400 to 1,000 ms of current supply is preferable.

The upper mold restarts descending motion of the upper mold 100 while the electrical current is still applied to the workpiece through the electrodes. The electrical supply may be maintained until the forming stroke of the upper mold 100 is finished. Pulsed direct current is used in forming the steel workpiece. A single pulse of direct current may be used in the case of trimming the steel workpiece.

A trimming process according to an embodiment will be described with reference to FIG. 10.

Figure 10:
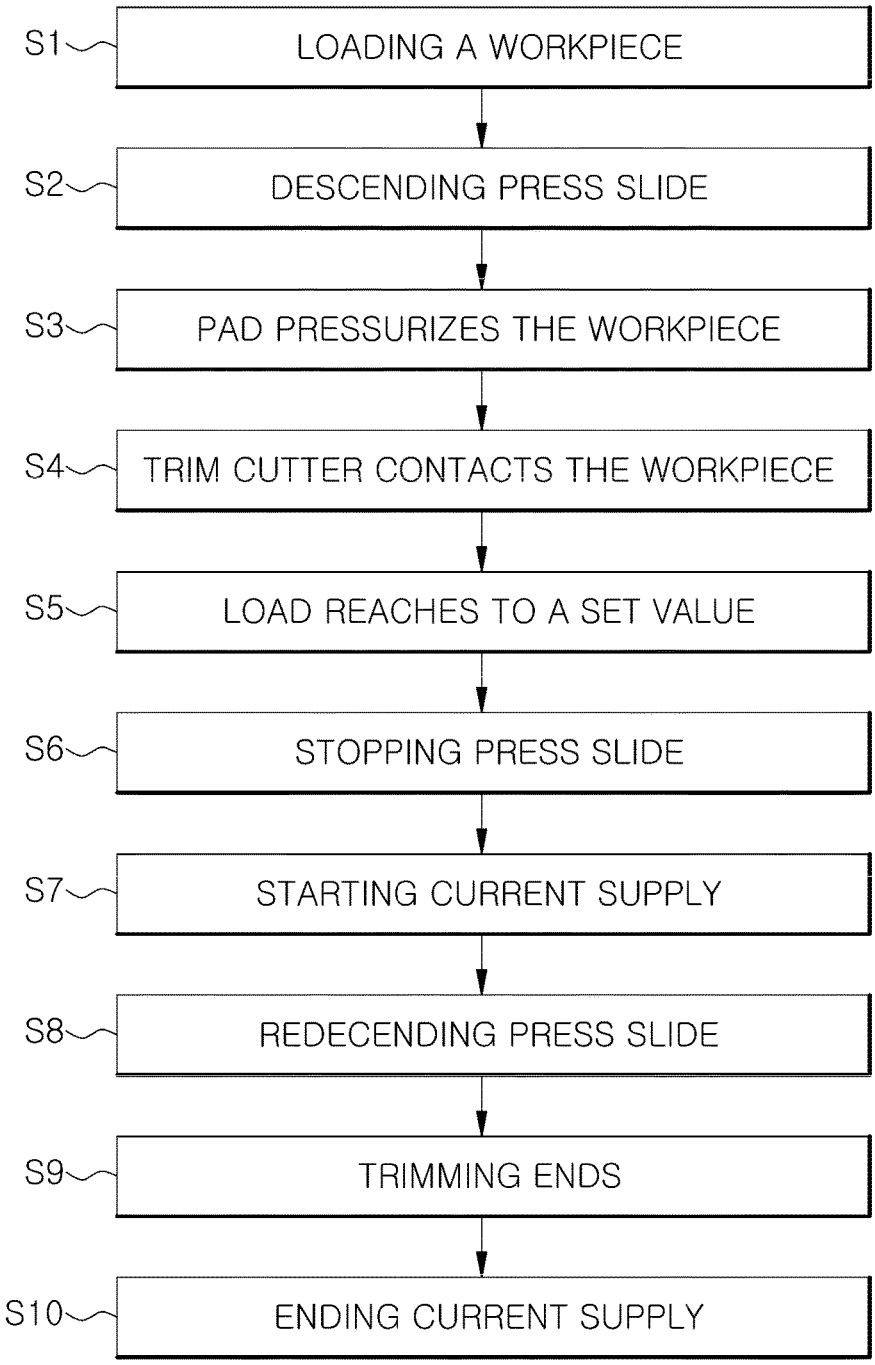
FIG. 10 is a flowchart showing a process of the electroplastic forming according to the embodiment of the present invention.

Referring to FIG. 10, the trimming process according to the embodiment is divided into an workpiece loading process S1, processes S2 to S6 for moving a slide to a current supply start-up position, and current supplying and trimming processes S7 to S10.

In the workpiece loading process S1, the workpiece W is loaded on the steel assembly 210 of the lower mold 200 in which the electrodes 30 are disposed.

Next, the slide of the press 10 starts to descend in process S2, when the slide continuously descends after the pad 110 of the upper mold 100 contacts the workpiece W, the pad 110 pressurizes the workpiece W in the process S3. In FIG. 9, an area ① on which a shearing force gradually increases is not in a state in which the workpiece W is pressurized by the pad 110. The shearing force increases as the trim cutter 121 presses the workpiece W.

In process S4, when the slide continuously descends, the trimming cutter 121 contacts the workpiece W. In process S5, a load reaches a predetermined load setting value, in process S6, the control unit 50 transmits a stop command to the press 10 to temporarily stop the slide. A slide stopped time may be preset in the control part of the press 10.

In process S7, the control unit 50 transmits a current supply starting command to the power supply 40 to start the supply of the current to the electrodes 30. In process S8, after a predetermined time elapses, the slide is restarted to descend by the control part of the press 10 or by the command from the control unit 50.

In process S9, after the trimming is completed, that is, the upper mold 100 reaches a bottom dead point, the power supply 40 finishes the supply of the current to transmit the current supply ending signal to the control unit 50, and a next trimming process is prepared.

The above-described apparatus for forming the high strength steel workpieces according to the present invention may be used in trimming or other types of forming for the high strength steel workpieces. The workpiece may include a blank or steel sheet to be press-formed.

Also, the forming apparatus according to the present invention may accurately control or monitor the electroplastic forming process, and thus high strength steel workpieces having high quality may be obtained.

Also, the forming apparatus according to the present invention may accurately control the timing at which the current is supplied to the workpiece, and monitor/manage the amount, duration and pulsing interval of the electrical current being supplied to the workpiece at a desired level. Thus, various types of electrically-assisted forming process can be tested and forming conditions can be drawn for commercialization of a forming process with the apparatus.

The above-disclosed subject matter is to be considered illustrative and not restrictive, and the appended claims are intended to cover all such modifications, enhancements, and other embodiments, which fall within the true spirit and scope of the inventive concept. Thus, to the maximum extent allowed by law, the scope of the inventive concept is to be determined by the broadest permissible interpretation of the following claims and their equivalents, and shall not be restricted or limited by the foregoing detailed description.

What is claimed is:

1. An apparatus for forming a steel workpiece, the apparatus comprising:

a press comprising an upper mold and a lower mold and is configured to temporarily stop movement of the upper mold at a controlled position;

electrodes for applying electrical current to the workpiece loaded on the lower mold;

at least one power supply for supplying the electrical current to the electrodes;

a control unit for controlling the power supply; and a first sensor disposed on the upper mold or the lower mold to measure a force applied to the workpiece and transmit the measured values to the control unit, wherein the control unit controls a start timing of the power supply to supply the electrical current to the electrodes by using the values from the first sensor, wherein the lower mold comprises:

a lower die; and a steel assembly disposed on the lower die and contacting the workpiece loaded on the lower mold, wherein the electrodes are disposed on the steel assembly and protrude above a surface of the steel assembly facing the workpiece so that the electrodes contact the workpiece in advance of the steel assembly, and wherein an insulation material having elasticity is disposed between the electrodes and the steel assembly.

2. The apparatus of claim 1, further comprising a second sensor disposed between the power supply and the electrodes, wherein the second sensor measures the electrical current being supplied from the power supply to the electrodes and transmits the measured values to the control unit.

3. The apparatus of claim 1, further comprising a third sensor to measure the movement of the upper mold and transmit the measured values to the control unit.

4. The apparatus of claim 1, wherein the press is configured to stop the movement of the upper mold descending to the lower mold on or before the start timing.

5. The apparatus of claim 4, wherein the press is configured to restart the descending movement of the upper mold after the start timing while the electrical current is applied to the workpiece.

6. The apparatus of claim 5, wherein the electrical current is applied to the workpiece at least 400 ms.

7. The apparatus of claim 1, wherein the electrical current is applied to the workpiece from the electrodes while the workpiece is deformed.

8. The apparatus of claim 1, wherein each of the electrodes belongs to one group of at least two groups, and at least two power supplies are provided, and each of the power supplies is connected to one of the electrode groups to supply the electrical current independently with respect to other electrode groups.

9. The apparatus of claim 8, wherein each of the power supplies comprises:

a first part generating pulsed direct current having a controlled duration and a controlled magnitude; and a second part spaced apart from and electrically connected to the first part to transform the current from the first part into a controlled current with a controlled voltage required for electroplastic deformation of the workpiece, wherein the second part is disposed in the lower mold to supply the transformed current to the one of the electrode groups.

10. The apparatus of claim 1, wherein the upper mold comprises:

an upper die; and a pad covering the upper die and elastically supported by the upper die so that the pad holds the workpiece before the upper die contacts the workpiece.

11. The apparatus of claim 10, wherein the upper die comprises;

a forming part which is a trim cutter; and columns standing perpendicularly from a base of the upper die and having the forming part secured on a front edge thereof, wherein the forming part is configured to protrude through corresponding holes formed in the pad.

12. The apparatus of claim 11, wherein the first sensor comprises a strain gage disposed in a mounting groove formed in a surface of the forming part, and wherein the surface is parallel with a moving direction of the forming part and the strain gage is insulated in the groove.

13. The apparatus of claim 1, wherein the electrodes are disposed in the lower mold so that the electrodes protrude above a surface of the lower mold on which the workpiece is laid.

14. An apparatus for forming a steel workpiece, the apparatus comprising:

a press comprising an upper mold and a lower mold and is configured to temporarily stop movement during a deformation stroke of the upper mold;

electrodes for applying electrical current to a portion of the workpiece loaded on the lower mold;

power supplies for supplying the electrical current to the electrodes;

a control unit for controlling the power supplies;

a first sensor disposed on the upper mold or the lower mold to measure a force applied to the workpiece and transmit the measured values to the control unit; and a second sensor disposed between the power supplies and the electrodes, wherein the second sensor measures the electrical current being supplied from the power supplies to the electrodes and transmits the measured values to the control unit;

wherein each of the electrodes belongs to one group of at least two groups and each of the power supplies is electrically connected to one of the electrode groups to supply the electrical current independently with respect to other electrode groups, and wherein each of the power supplies comprises, a first part generating pulsed direct current having a controlled duration and a controlled magnitude; and a second part electrically connected to the first part to transform the current from the first part into a controlled current with a controlled voltage required for electroplastic deformation of the workpiece and disposed in the lower mold apart from the first part to supply the transformed current to the one of the electrode groups, and wherein the control unit controls a start timing of the power supplies to supply the electrical current to the electrodes by using input data from the first sensor, and the control unit receives operating data from the press and an ending signal of the current supply from the power supplies, and is ready for triggering the power supplies to supply the current to the electrodes for a next deformation stroke of the press using the operating data and the ending signal.

* * * * *